US005893803A

United States Patent [19]

Leadbetter et al.

[11] Patent Number: 5,893,803

[45] Date of Patent: Apr. 13, 1999

[54] PUTTING STROKE TRAINING DEVICE

[76] Inventors: David Leadbetter, 9606 Tavistock Rd., Orlando, Fla. 32827; George P. Lee, III, 640 Oak Ter., Norcross, Ga. 30071

[21] Appl. No.: 08/992,512

[22] Filed: Dec. 17, 1997

[51] Int. Cl.[6] ..... A63B 69/36

[52] U.S. Cl. ..... 473/206; 473/208; 473/229; 473/274

[58] Field of Search ..... 437/208, 229, 437/274, 275, 205, 206

[56] References Cited

U.S. PATENT DOCUMENTS 3,937,465 2/1976 Roland ..... 473/229 X 5,149,099 9/1992 Radakovich ..... 473/208

5,688,184 11/1997 Johnson ..... 473/208 X

*Primary Examiner*—George J. Marlo

*Attorney, Agent, or Firm*—Aquilino & Welsh

[57] ABSTRACT

A golf training device for training a golfer to execute a putting stroke including a neck engaging member, a longitudinal strap having a first end attached to the neck engaging member and a free end. The strap includes a weighted ring which causes the strap to hang downwardly in a vertical direction when the neck engaging member is placed around the neck of a golfer and used during the execution of a putting stroke. In use, a golfer grasps the strap holding it firmly against a handle of a golf club thereby fixing the distance between the hands and his shoulders, neck and head, ensuring a repetitive consistent putting stroke.

7 Claims, 2 Drawing Sheets

PUTTING STROKE TRAINING DEVICE

BACKGROUND AND SUMMARY OF THE INVENTION

The present invention relates to a golf swing training device and, more particularly, to a training device for enhancement of a golfer's putting stroke.

One factor in promoting a smooth and efficient putting stroke is to maintain the relationship between the moving parts of the body and the golf club, and the non-moving parts of the body during the execution of the actual stroke. In particular, it is desirable to maintain the arms and hands of a golfer and the golf club, at the same distance to the torso during the execution of the stroke.

There are many golf swing training devices in the nature of harnesses and the like for facilitating the correct swinging of a golf club and for creating a repetitive golf swing. Among these are the following. U.S. Pat. No. 3,442,513 to Fisher relates to a golf training apparatus including a neck engaging loop, a belt and a base, all of which are connected by means of a cord in an effort to maintain the golfer's body parts relatively constant during the execution of a stroke.

U.S. Pat. No. 3,677,551 to Shouse shows a golf training device including a base plate for locating the feet, a loop for encircling the neck, and a connector between the base and loop having an adjustable break-away coupling which will disengage if an incorrect golf swing is made.

U.S. Pat. No. 4,134,589 to Arena shows a golf swing training device including a flexible, non-stretchable cord forming a loop from the golfer's hands around his neck through an aperture on the ground surface and back to the user's belt. The device maintains the golfer in a proper position while pivoting.

U.S. Pat. No. 4,662,640 to Grander is directed to a golf swing training device including a harness adapted to fit about the shoulders and torso of the user and which includes a V-shaped suspended assembly connected to the grip of a training club. The V-shaped elements are maintained at substantially the same tension during the critical areas of the swing.

U.S. Pat. No. 5,149,099 to Radkadovich shows a golf swing training device formed of an elastic loop which is fixed to the body of the player and disposed so that it rests on the shoulders and chest of the user. The handle of the club is laid inside the loop and pushed downward and outward by the left hand to stretch the loop during the swing to create control of the user's arms. Ideally this results in a perfect level swing plane and squaring of the club face.

U.S. Pat. No. 5,451,060 to Dalbow relates to a stroke enhancing device including a harness having a loop which extends around one shoulder of a golfer and includes an end which is held by a golfer in his leading hand to maintain the arms in proper position during the execution of a golf swing.

The present invention relates to a golf swing training apparatus specifically designed to enable a golfer to form a repetitive, consistent putting stroke. The device includes an adjustable loop worn around the neck of the user and includes a flexible, weighted, flat sided strap or ribbon extending downwardly from the loop to be engaged by the hands of the user during the execution of a stroke. The strap or ribbon includes a metal ring having sufficient wieght to cause the strap or ribbon to hang straight down in a vertical direction from the neck engaging loop when it is worn by a golfer. In use, the loop is placed around the neck of the golfer and the strap or ribbon falls downwardly slightly away from the body of the user when the golfer assumes a natural set up for executing a putting stroke such that the head is slightly bowed forwardly and the body slightly bent over toward the ball. To practice the invention, a golfer places the weighted ring over the butt end of the grip or handle to locate the strap in place next to the handle of the golf club. The golfer then places a flat side of the ribbon or strap against the handle of the club while making his normal grip, holding the strap flat against the handle of the putter. Gripping the strap against the club handle limits movement of the handle and creates the tension between the golfer's hands and his upper shoulders and neck. Holding the strap prevents the golfer from extending his hands further away from his shoulders than the relative distance established by the length of the strap. Because the strap is relatively thin compared to the handle of the putter, there is no interference when the strap is grasped. Maintaining a firm grip on the strap against the club handle during the stroke, maintains the length of the arc between the user's hands and his shoulders, aiding the player to develop a consistent stroke while maintaining the putter head square to the target and along a preselected target line.

Among the objects of the present invention are the provision of a golf training device to enable a golfer to develop a smooth, consistent and repeatable putting golf stroke.

Another object of the present invention is the provision of a golf training device which is simple in structure and does not interfere with the golfer's placement of his hands on a putter when using the device to train the golfer.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
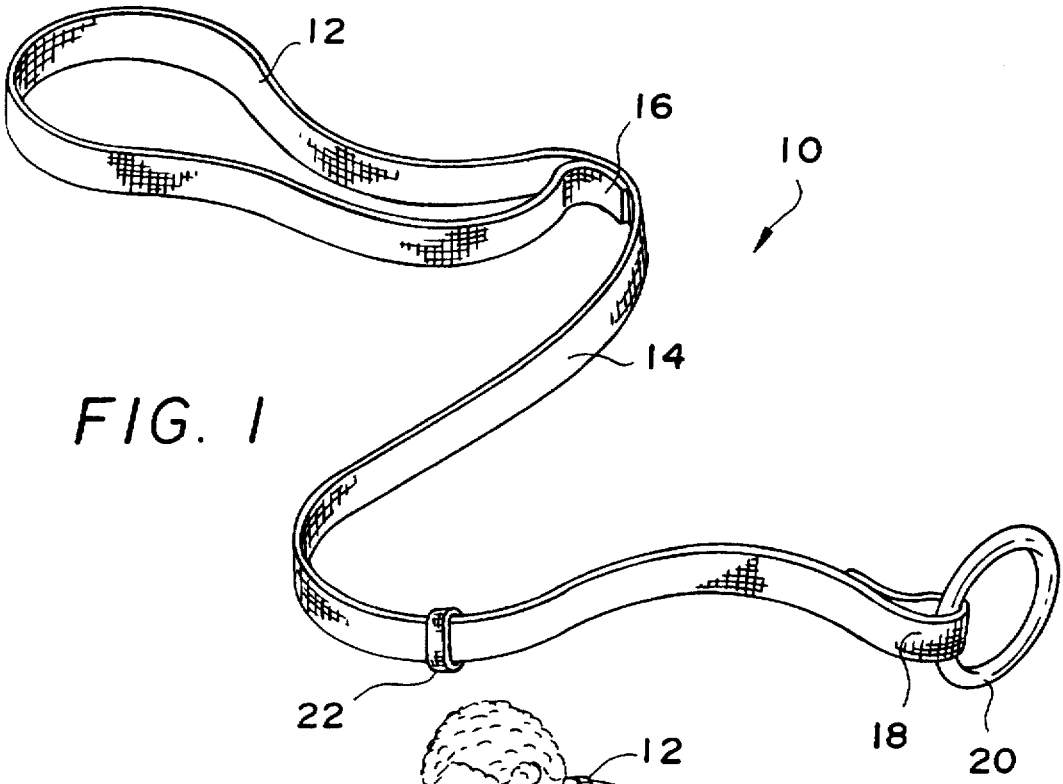
FIG. 1 is a perspective of a golf training device in accordance with the present invention.
Figure 2:
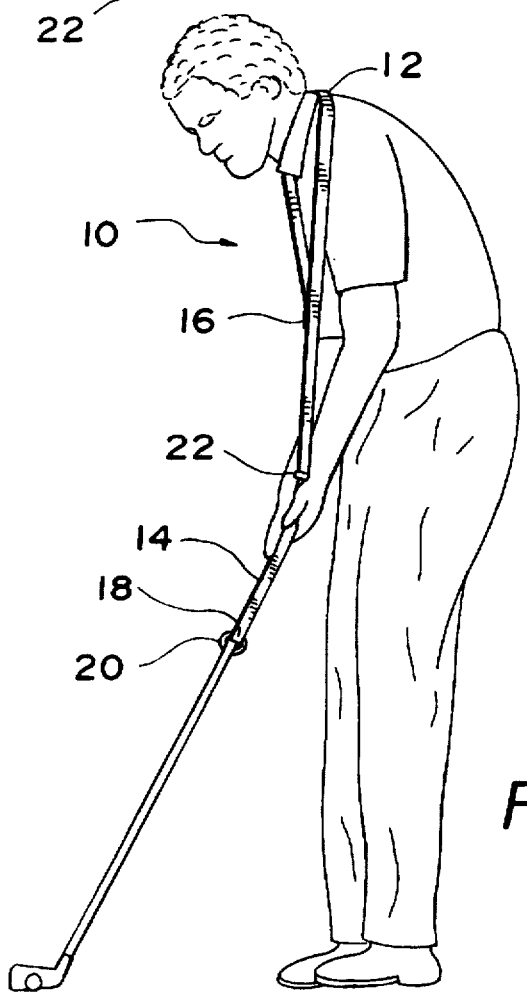
FIG. 2 is a side view of a golfer wearing the device of the present invention.
Figure 3:
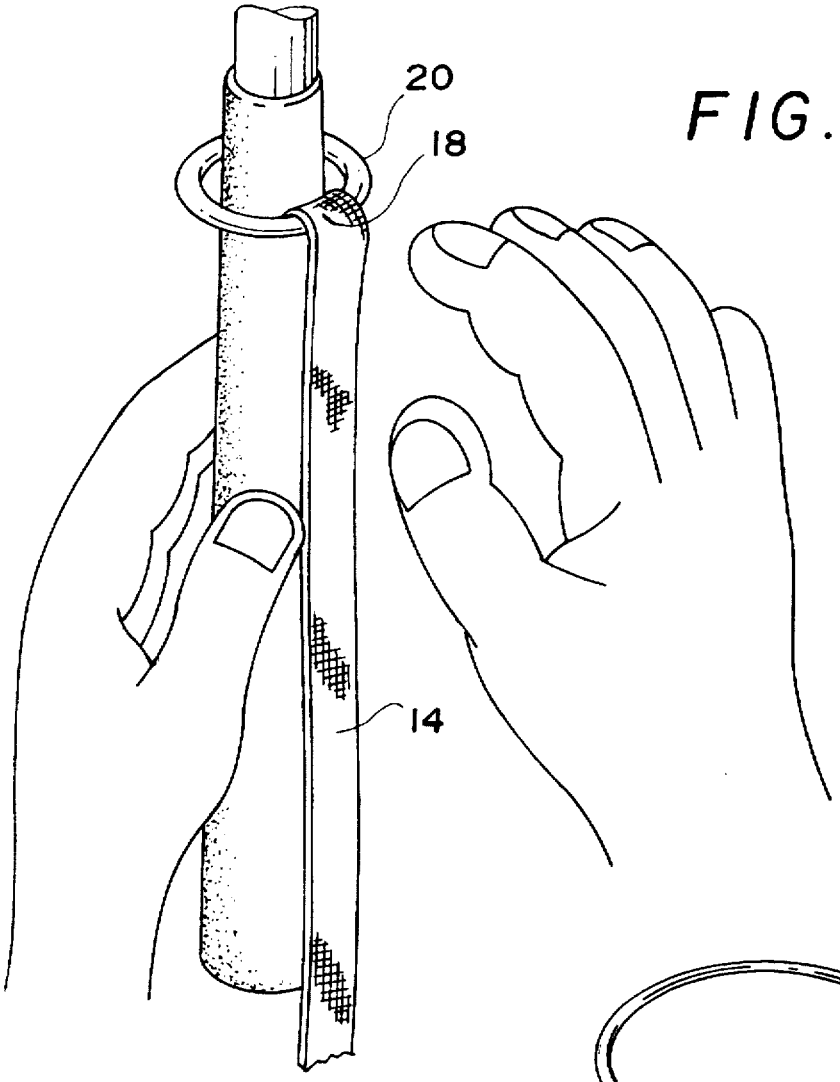
FIG. 3 is a view of a detail of the device positioned on a handle of a golf club.

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Referring to the drawings, a golf swing training device 10 of the present invention for aiding a golfer to develop a smooth and precise putting stroke, includes a neck engaging loop 12, a ribbon or strap 14 having a first end 16 fixed to the loop 12 and a free end 18. Preferably, loop 12 and strap 14 are integrally formed from a lightweight material having flat sides with minimum thickness to provide minimum interference when grasped by the hands of the user and held against the handle of a golf club. Preferably, the device includes a weighted ring 20 attached to the free end 18 of the strap 14, causing the strap 14 to hang downwardly when the player assumes a normal position taken during the execution of a putting stroke. The ring 20 is sized to fit over the butt end of a golf club to locate the strap 14 proximate the handle of the golf club. A moveable locator 22 may be provided on the strap 14 to aid a golfer to position his hands on the same place on the strap 14.

In use, the golfer places the loop 12 about his neck so that it lies on his shoulders with the flexible strap 14 extending downwardly opposite the golfer's chest. Because the strap 14 is weighted by the ring 20 and the loop 12 is easily moved on the user's neck and shoulders, the strap 14 will always assume a vertical position relative to the ground surface on which the golfer is standing. When a golfer bends slightly forward to assume the position normally taken during the execution of a putting stroke, the strap 14 will fall slightly away from the body of the user so that it dangles free in a downward direction. To use the device 10, the golfer places the weighted ring 20 over the butt end of the handle or grip of the golf club and simply places a flat end of the strap 14 against the handle of the golf club at the same time he grips the golf club, trapping the strap against the golf club grip so that it cannot move relative to the golfer's hands. This establishes a fixed position of the golfer's hands on the strap relative to the loop 12 and in turn, establishes a fixed position of the golfer's hands relative to the top of his shoulders, head and neck at the address position prior to the execution of the putting stroke.

When a stroke is initiated, the hands are maintained relative to the head and shoulders by the fixed length of the strap 14 and loop 12. It will be appreciated that any attempt to swing the arms outwardly, further away from the golfer's body will be restricted as long as the strap 14 is grasped and held firmly trapped against the golf club. This maintains a constant radius between the hands of the golfer and his head, neck and shoulders, ensuring that the same swing plane will be repeated for each golf stroke as long as the strap is gripped at the same place.

To ensure this occurs, the movable locator 22 is positioned relative to the hands of the golfer to provide a reference point so that a golfer may grip the strap 14 at the same place along the length of the strap 14 during subsequent putting strokes.

Figure 4:
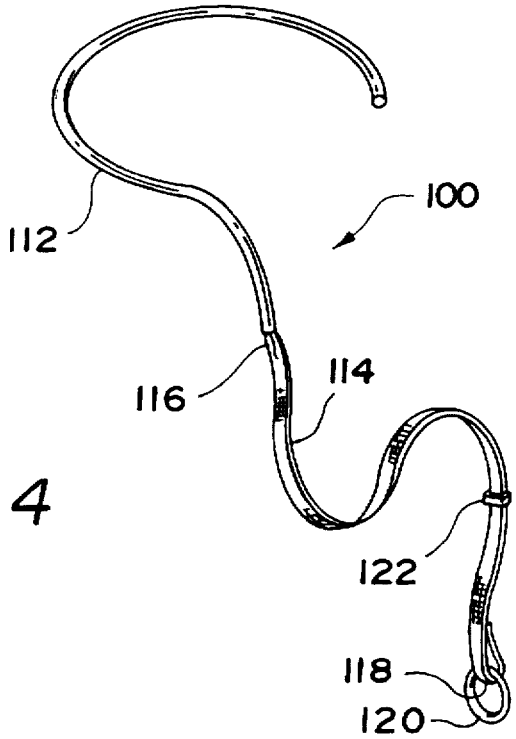
FIG. 4 is a perspective view of a second embodiment of a golf training device in accordance with the present invention.

FIG. 4 shows a second embodiment of a training device 100 in accordance with the present invention. The device 100 is similar to the embodiment described herinabove except for the use of a hook 112 which is designed to engage the neck of a golfer in place of a loop. A strap 114 having a fixed end 116 is attached to the hook 112 and includes a free end 118 with a ring 120 and a locator 122. In use the device 100 operates the same as the embodiment described above with the hook 112 being placed on the neck of the golfer.

While various preferred embodiments have been shown and described, it will be understood that there is no intent to limit the invention by such disclosure. For example, the neck engaging loop and strap may be separately attached parts. The shape and size of the strap may vary as long as the golfer is able to grip and trap the same against the grip or handle of a golf club without being unduly encumbered by the size thereof. Therefore it is intended to cover all modifications and alternate constructions falling within the spirit and scope of the invention as claimed.

We claim:

1. A golf swing training device for training a golfer to execute a golf swing comprising:

a neck engaging member; and a flexible elongated member having a fixed end attached to said neck engaging member and extending downwardly therefrom in a vertical direction when said neck engaging member is worn by a golfer standing on a support surface, said elongated member including an engagement surface for engagement of a handle of a golf club by the hands of a golfer while holding the handle of the golf club; said flexible elongated member having a free end including a means for movably attaching said free end of said member to an upper handle portion of a golf club.

2. The training device according to claim 1, wherein said neck engaging member is a loop.

3. The training device according to claim 1, wherein said neck engaging member is a hook.

4. The training device according to claim 1, wherein said neck engaging member is a strap having flat sides integrally formed with said flexible elongated member.

5. The training device according to claim 1, wherein said means for movably attaching is a ring-shaped weight, sized to be placed over said handle portion of the golf club and to be freely movable along a length of said handle portion of the golf club.

6. The training device according to claim 1, wherein said flexible elongated member is a strap and said surface for engagement of a handle is a flat side of said strap.

7. The training device according to claim 1, further including a locator on said flexible elongated member to provide a reference position along said flexible elongated member for a golfer's hands when using said training device.

* * * * *